US010093325B2

(12) United States Patent
Blanco et al.

(10) Patent No.: US 10,093,325 B2
(45) Date of Patent: Oct. 9, 2018

(54) TRANSPORT TANKER REINFORCEMENT

(71) Applicant: GATX Corporation, Chicago, IL (US)

(72) Inventors: Rosario A. Blanco, West Chicago, IL (US); Gabriel L. Buzas, Clarendon Hills, IL (US); Peter R. Manyek, Highland, IN (US); Raul C. Rosiles, Waukegan, IL (US)

(73) Assignee: GATX Corporation, Chicago, IL (US)

( * ) Notice: Subject to any disclaimer, the term of this patent is extended or adjusted under 35 U.S.C. 154(b) by 0 days.

(21) Appl. No.: 14/552,698

(22) Filed: Nov. 25, 2014

(65) Prior Publication Data

US 2015/0083021 A1 Mar. 26, 2015

Related U.S. Application Data

(63) Continuation of application No. 13/690,681, filed on Nov. 30, 2012, now Pat. No. 8,919,261.

(Continued)

(51) Int. Cl.

| | |
|---|---|
| ***B61D 5/06*** | (2006.01) |
| ***B65D 88/12*** | (2006.01) |
| ***B65D 90/14*** | (2006.01) |

(52) U.S. Cl.

CPC ..... *B61D 5/06* (2013.01); *B65D 88/128* (2013.01); *B65D 90/14* (2013.01); *Y10T 29/49618* (2015.01); *Y10T 29/49826* (2015.01)

(58) Field of Classification Search

CPC ..... B61D 5/06; B61F 1/02; B61F 1/10; B65D 88/128; B65D 90/14; Y10T 29/49618; Y10T 29/49826

(Continued)

(56) References Cited

U.S. PATENT DOCUMENTS

| | | | |
|---|---|---|---|
| 2,267,338 | A | 12/1941 | Nugent |
| 3,043,599 | A | 7/1962 | Meyer |

(Continued)

FOREIGN PATENT DOCUMENTS

| | | |
|---|---|---|
| EP | 0677425 | 6/1998 |

OTHER PUBLICATIONS

International Preliminary Report on Patentability issued in corresponding International Application No. PCT/US2012/067319 dated May 14, 2015.

(Continued)

*Primary Examiner* — Mark T Le

(74) *Attorney, Agent, or Firm* — Jeffrey T. Placker; Holland & Knight LLP

(57) ABSTRACT

A transport tanker and a method of reinforcing a transport tanker are generally provided. The transport tanker may include a tank body, and a coupling structure, including a web extending from the tank body, for transferring a towing load to the tank body. A load spreading structure may be affixed to the tank body and configured to spread at least a portion of a load experienced by the tank body in a region proximate a terminal end of the web. The load spreading structure may include a reinforcing member including a elongated U-shaped member including two legs joined at a first end by an arcuate section. A respective one of the two legs may be at least partially disposed on opposed sides of the web with web at least partially received within an open second end of the U-shaped member.

19 Claims, 5 Drawing Sheets

Related U.S. Application Data

(60) Provisional application No. 61/565,189, filed on Nov. 30, 2011.

(58) Field of Classification Search
USPC ..... 105/360, 358, 413, 416, 362
See application file for complete search history.

(56) References Cited

U.S. PATENT DOCUMENTS

| | | | | |
|---|---|---|---|---|
| 3,626,867 | A | 12/1971 | Becker | |
| 3,631,815 | A | 1/1972 | Heap et al. | |
| 3,685,458 | A * | 8/1972 | Price | B65D 88/744 105/358 |
| 4,805,540 | A * | 2/1989 | Mundloch | B61D 5/06 105/358 |
| 5,467,719 | A | 11/1995 | Dairymple et al. | |
| 6,357,363 | B1 | 3/2002 | Miltaru | |
| 6,402,199 | B1 | 6/2002 | Wojnowski | |
| 7,806,058 | B2 | 10/2010 | Saxton et al. | |
| 8,919,261 | B2 * | 12/2014 | Blanco | B65D 88/128 105/358 |

OTHER PUBLICATIONS

The International Search Report and the Written Opinion of the International Searching Authority dated Jan. 23, 2013 and dated Feb. 22, 2013 in corresponding PCT Application No. PCT/US12/67319.

* cited by examiner

DETAIL B

TRANSPORT TANKER REINFORCEMENT

CROSS-REFERENCE TO RELATED APPLICATIONS

This application is a continuation of U.S. patent application Ser. No. 13/690,681, filed Nov. 30, 2012, which claims the benefit of U.S. provisional patent application Ser. No. 61/565,189, filed on 30 Nov. 2011, the entire disclosure of which is incorporated herein by reference.

TECHNICAL FIELD

This application generally relates to tank transport carriers, and more particularly relates reinforcing structures for use with frame components of tank transport carriers.

BACKGROUND

Material transport is a crucial aspect of modern economies. A wide variety of raw materials, intermediate products, and finished goods are constantly being shipped across the globe, and through countries. For example, raw material must be transported from a point of origin, such as where the raw materials are harvested, mined, or otherwise produced, to locations where the raw materials can be process to produce intermediate products or finished goods. Similarly, intermediate products may further be transported to still other locations where they can be further transformed to produce finished goods. Such finished goods must often be transported further to bring the goods to market. Such constant transportation is often required because each link in the production chain may require a different combination of resources, including natural resources, available labor, suitable economic environment, and so forth.

Various different modes of transport are available to suit different varieties of products and different geographic avenues of shipment. In the case of liquid and gaseous products, bulk transport often relies on tank containers of some variety that may be suitable for holding liquids or gasses, and that may also facilitate easy loading and off-loading of the liquids or gasses. Such tank containers may be configured, for example, as a railcar for transport via railroad, as a towable trailer for transport by highway, e.g., towed by a tractor as part of a tractor-trailer assembly, or otherwise configured for suitable transport.

SUMMARY OF THE DISCLOSURE

According to an implementation, a transport tanker may include a tank body, and a coupling structure proximate a first end of the tank body for transferring a towing load to the tank body. The coupling structure may include a web protruding from the tank body, and affixed to the tank body. The transport tanker may also include a load spreading structure affixed to the tank body. The load spreading structure may be configured to spread at least a portion of a load experienced by the tank body in a region proximate a terminal end of the web across an enhanced longitudinal expanse of the tank body.

One or more of the following features may be included. The load spreading structure may include a reinforcing member including a elongated U-shaped member. The elongated U-shaped member may include two legs joined at a first end by an arcuate section and open at a second end opposite the first end. A respective one of the two legs may be at least partially disposed on opposed sides of the web, such that the web may be at least partially received within the open second end of the U-shaped member. The reinforcing member may include a first height proximate the first end, and a second height proximate the terminal end of the web, in which the first height may be less than the second height. The reinforcing member may also include a third height proximate the second end. The third height may be less than the second height. The reinforcing member may also include a bridge plate extending between the two legs proximate the terminal end of the web.

The transport tanker may further include a longitudinal pad affixed to a longitudinal wall of the tank body. The web may be affixed to the tank body via the pad. The reinforcing member may be affixed to the tank body via the pad. The web and the reinforcing member may be welded to the pad. The reinforcing member may be welded to the pad via a weld about an outer perimeter of the U-shaped member. The reinforcing member may be welded to the pad via a fillet weld about the arcuate section.

The transport tanker may include rail tank car. The coupling structure includes a draft sill structure of the rail car. The transport tanker may include a tanker trailer. The coupling structure may include a fifth wheel coupling structure of the trailer.

According to another implementation, a transport tanker may include a rail tank car including a tank body. A sill pad including a longitudinal member may be welded along a portion of longitudinal wall of the tank body. A draft sill structure may be disposed proximate a first end of the tank body, and the draft sill structure may include a draft sill web welded to the sill pad. The draft sill structure may further include a rail car coupler. The transport tanker may also include a reinforcing member welded to the sill pad. The reinforcing member may include an elongated U-shaped member including two legs joined at a first end by an arcuate section and open at a second end opposite the first end. A respective one of the two legs may be at least partially disposed on either side of the draft sill web. The reinforcing structure may have a first height proximate the first end and a second height proximate a terminal end of the draft sill web. The first height may be less than the second height. The reinforcing structure may also have a third height proximate the second end. The third height may be less than the second height.

One or more of the following features may be included. The reinforcing structure may taper between the first height and the second height. The reinforcing structure may taper between the second height and the third height. The reinforcing structure may be welded to the sill pad about an outer perimeter of the elongated U-shaped member. The reinforcing member may be welded to the sill pad via a fillet weld about the arcuate portion.

According to another implementation, a method for reinforcing a transport tanker may include providing a reinforcing member including a elongated U-shaped member. The elongated U-shaped member may include two legs joined at a first end by an arcuate section and open at a second end opposite the first end. The method may also include affixing the reinforcing member to a tank body of the transport tanker such that a respective one of the two legs is at least partially disposed on opposed sides of a web of a coupling structure affixed proximate a first end of the tank body. The web may protrude from the tank body and may be affixed to the tank body.

One or more of the following features may be included. Affixing the reinforcing member to the tank body may include welding the reinforcing member to the tank body about an outer perimeter of the elongated U-shaped member. Welding the reinforcing member to the tank body may include fillet welding the reinforcing member to the tank body about the arcuate portion. The web may be affixed to the tank body via a longitudinal pad affixed to a longitudinal wall of the tank body. Affixing the reinforcing member to the tank body may include welding the reinforcing member to the pad.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF EXAMPLE EMBODIMENTS

Figure 1:
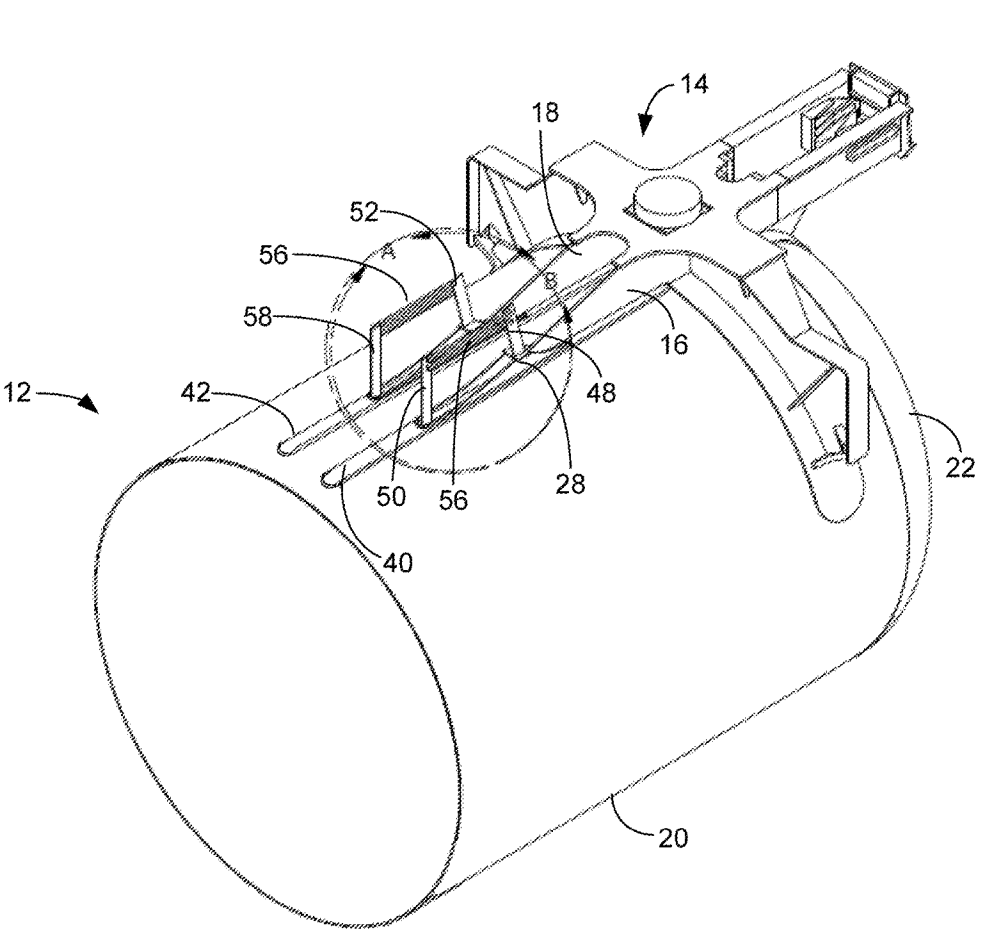
FIG. 1 diagrammatically depicts an underside view of a portion of an example embodiment of a transport tanker, according to an embodiment of the present disclosure.

Referring to FIG. 1 there is shown a portion of transport tanker 10 that may generally include tank body 12 (one end of which is depicted in the illustration of FIG. 1) and coupling structure 14, generally, which may be affixed to tank body 12 proximate a first end. While not shown, additional coupling structures may similarly be affixed to tank body 12 proximate an opposite end, e.g., to thereby provide coupling structures associated with each end of tank body 12. As used herein, transport tanker 10 may include a transport tank, for example, which may be configured for containing and transporting liquid and/or gaseous material, that may be integrated into a transport vehicle, for example, through the direct or indirect attachment of rail trucks (e.g., wheel assemblies) or wheels, and coupled with a means of locomotion. Examples of transport tankers as used herein may include, but are not limited to, a rail tank car, as may utilized in connection with railroad transport, a tank trailer, as may be utilized in connection with a tractor-trailer configuration, or the like.

In some embodiments, the tank body may be configured as a structural component, or semi-structural component in which at least a portion of the structural loads and/or demands of transport tanker 10 may be carried by tank body 12. For example, coupling structure 14 may be affixed to tank body 12, whereby at least a portion of towing loads may be transferred to tank body 12 via coupling structure 14. As will be shown and described in greater detail below, coupling structure 14 may include one or more webs (e.g., web 16, 18) protruding and/or extending from, and affixed to, tank body 12.

As generally shown, tank body 12 may, at least in part, define a tank for containing liquid or gaseous materials. Tank body 12 may generally include longitudinal wall 20, which may generally provide a generally cylindrical structure. Of course, longitudinal wall 20 may define configurations other than a cylindrical structure, for example, longitudinal wall may generally define a structure having an oval cross-sectional shape, and/or other suitable shape. Tank body 12 may further include respective end wall (e.g., end wall 22) at opposed ends of longitudinal wall 20. End wall 22 may include various configurations, such as generally planar, convex, concave, and/or conical. As generally described, tank body 12 may include a variety of configurations (e.g., a variety of cross-sectional profiles, end wall configuration, and the like) that may be, for example, suited for containment and transport of different materials. Similarly, tank body 12 may include various additional/alternative features, such as double wall configurations, liners, circumferential and/or longitudinal structural members, etc., suited for containment and transport of different materials (e.g., various liquids, low pressure gasses, pressurized gasses, etc.). As such, the illustrated and described considerations are intended only for the purpose of illustration, and should not be construed as a limitation on the present disclosure.

Transport tanker 10 may also include a load spreading structure affixed to tank body 12. The load spreading structure may be configured to spread at least a portion of a load experienced by the tank body in a region proximate a terminal end of the web (e.g., webs 16, 18 of coupling structure 14) across an enhanced longitudinal expanse of tank body 12.

Figure 2:
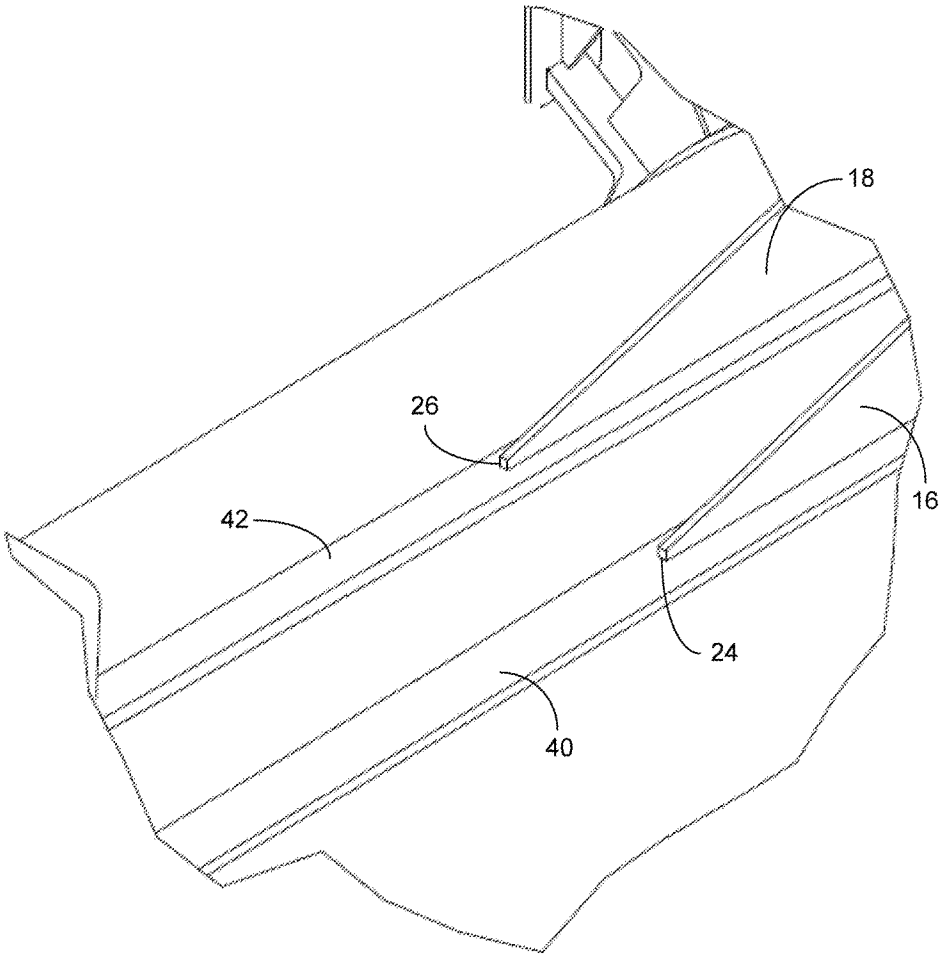
FIG. 2 diagrammatically depicts a detailed portion of the example transport tanker of FIG. 1 showing terminal ends of a coupling structure, according to an embodiment of the present disclosure.
Figure 3:
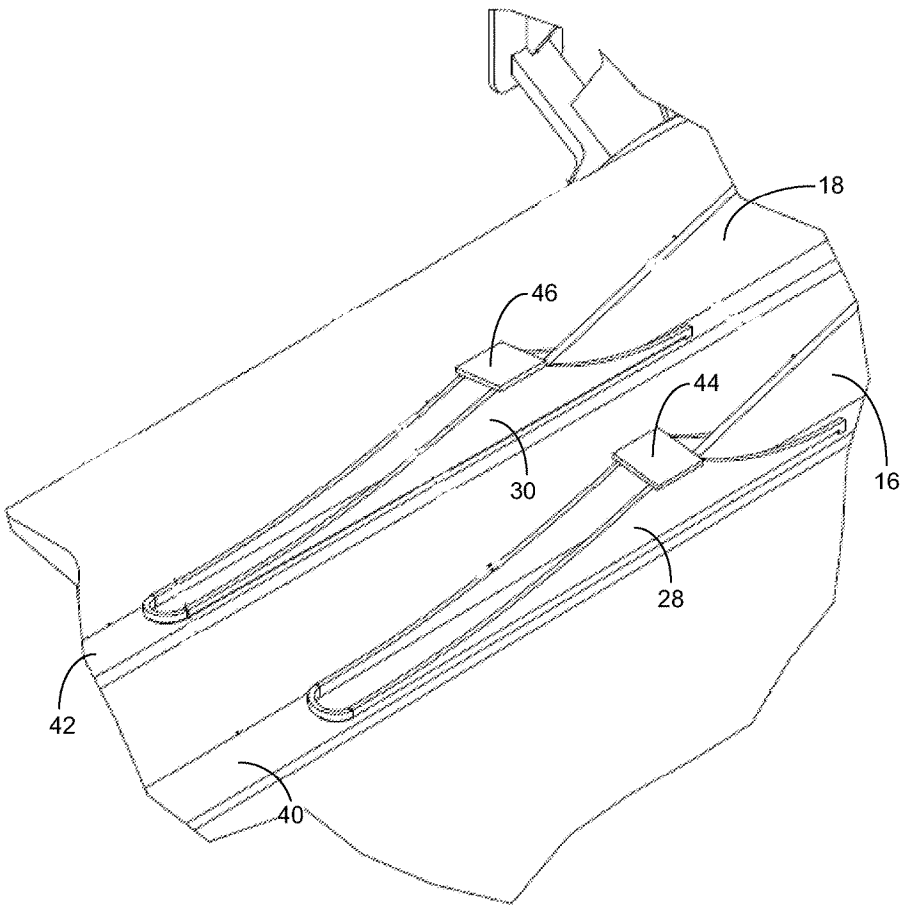
FIG. 3 diagrammatically depicts a detailed portion of the example transport tanker of FIG. 1 including load spreading structures, according to an embodiment of the present disclosure.

For example, and with reference also to FIG. 2, a detailed view of terminal end portions 24, 26 of webs 16, 18 is shown (e.g., without the load spreader for clarity of illustration of terminal end portions 24, 26). In general, a load (e.g., a towing load, a buff and/or draft load, etc.) applied to, or via, coupling structure 14 may result in a deformation of tank body 12 in the vicinity of terminal end portions 24, 26. For example, tank body 12 may be stiffened by webs 16, 18 in the region of tank body 12 affixed thereto. As such, a load applied via coupling structure 14 may create a moment or force concentration in the region where the stiffening effect of webs 16, 18 ends that may result in localized deformation of tank body 12. Because the resultant load may be distributed over a relatively small area of tank body 12, the stress developed may become very large and in some cases can exceed the yield strength of the surrounding material of tank body 12. Stress beyond the yield strength of the material may result in certain portions of the structure of tank body 12 taking a permanent set (e.g., which may not return to an original shape after the load has been removed). If enough of the surrounding material yields and takes a set, a residual stress may be induced in tank body 12, terminal ends 24, 26 of webs 16, 18, and/or a joint there-between, when the load is removed because the original geometry of tank body 12 may not be fully restored. In some situations, such a condition may cause an adverse effect on the fatigue life of transport tanker 10. Spreading the load over a larger foot print, or longitudinal expanse of tank body 12, (e.g., via the load spreading structure) may, in some cases, greatly reduce the stresses at this location of tank body 12 in the region of terminal ends 24, 26 of webs 16, 18.

In some situations the imparted loads and stresses, and/or residual stress resulting from such loads and stresses, may result in fatigue and crack development in the region of terminal ends 24, 26 of webs 16, 18. Once formed, these cracks may grow based on the service conditions to which transport tanker 10 is exposed. These conditions may create stress in the structure of transport tanker 10, specifically at the terminal ends 24, 26 of webs 16, 18. The load spreading structures may, in some embodiments, control or limit the stress levels to be within a certain range or magnitude to achieve an expected design service life (e.g., based on miles traveled per year) commonly known as a fatigue life. The load spreading structures may reduce and/or minimize crack development and/or growth by reducing the range and/or magnitude of stress developed during normal service operation.

Figure 4:
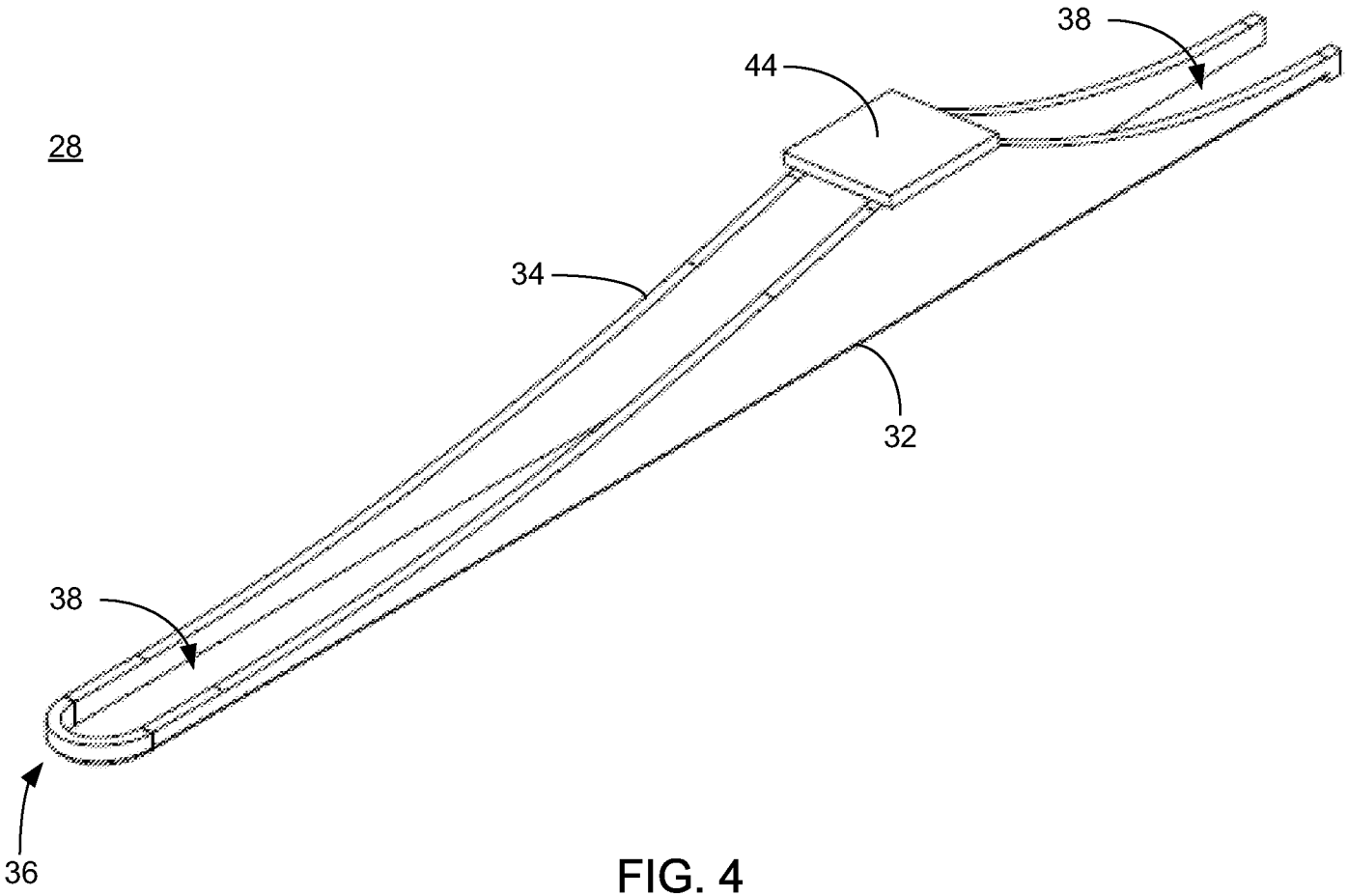
FIG. 4 is a perspective view of an example reinforcing member, according to an example embodiment of the present disclosure.
Figure 5:
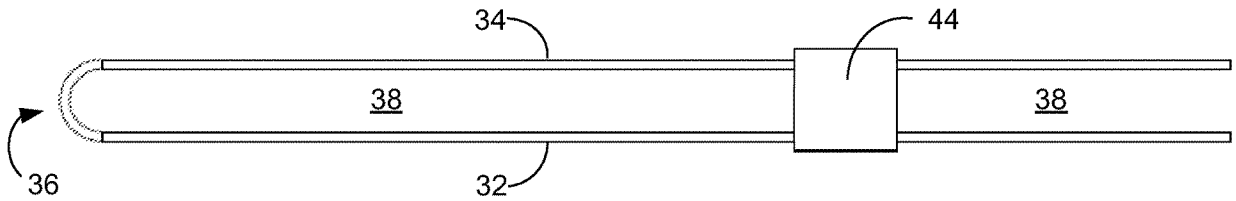
FIG. 5 is a plan view of the example reinforcing member of FIG. 4, according to an embodiment of the present disclosure.
Figure 6:
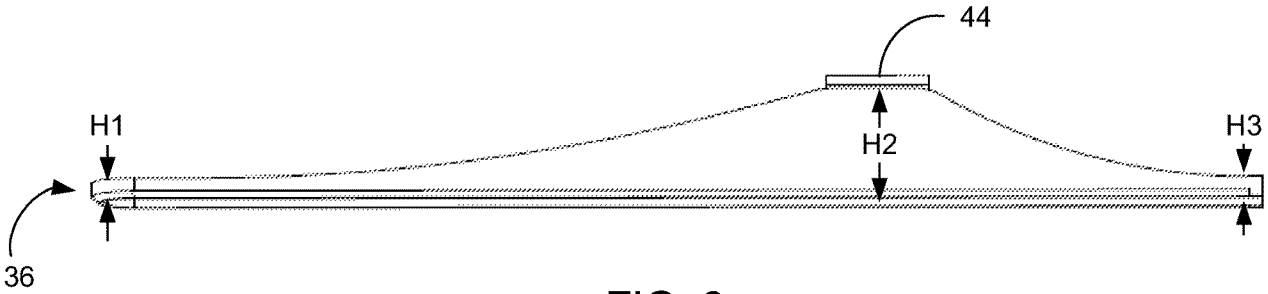
FIG. 6 is a side view of the example reinforcing member of FIG. 4, according to an embodiment of the present disclosure.
Figure 7:
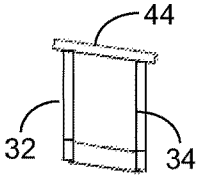
FIG. 7 is an end view of the example reinforcing member of FIG. 4, according to an embodiment of the present disclosure.

Referring also to FIGS. 3 through 7, according to an embodiment, the load spreading structure may include a reinforcing member (reinforcing members 28, 30). Reinforcing members 28, 30 may each generally include an elongated U-shaped member (e.g., which may generally have a length that may be greater than the width). With particular reference to FIGS. 4 through 6, the elongated U-shaped member of reinforcing member 28 may include two legs (e.g., 32, 34) joined at a first end by arcuate section 36 and open at a second end opposite the first end. In an embodiment, reinforcing member 28 may define interior region 38 of the elongated U-shaped member bounded by legs 32, 34 and arcuate section 36. A respective one of the two legs (e.g., legs 32, 34 of reinforcing member 28) may be at least partially disposed on opposed sides of the web (e.g., web 16), such that web 16 may be at least partially received within the open second end of the U-shaped member. For example, terminal end 24 of web 16 may be at least partially received within interior region 38 defined by reinforcing member 28, e.g., with web 16 extending into interior region 38 via the open second end of reinforcing member 28.

While specific implementations herein may relate to load spreading structures that may include generally elongated U-shaped reinforcing members, such a configuration is intended only for the purpose of explanation, and not of limitation. For example, load spreading structures consistent with the present disclosure may include one or more separate legs (e.g., generally longitudinal members) that may be employed in a manner generally consistent with the detailed description herein of elongated U-shaped reinforcing members 20, 30. Further, in some embodiments, a load spreading structure consistent with the present disclosure may include more than one legs that may be couple at a first end by a feature other than an arcuate section (e.g., a feature such as a straight member, or other suitable feature).

In one embodiment, reinforcing member 28, including respective legs 32, 34 disposed on either side of web 16 may locally reinforce the area surrounding the terminal ends (e.g., terminal end 24) of the webs (e.g., web 16) of coupling structure 14. For example, in some embodiments reinforcing members 28, 30 may limit the amount of deformation that tank body 12 experiences in service, for example during the Draft (tensile) and Buff (compressive) components of train loading conditions (e.g., in an embodiment in which transport tanker 10 may include a rail tank car). Limiting the deformation of tank body 12 may, in some situations, limit the amount of stress developed, and thereby increase the service and fatigue life of transport tanker 10. In some situations, reinforcing members 28, 30 may significantly reduce fatigue in the region of the terminal ends of the webs, and may, therefore, significantly increase the mileage to failure of the transport tanker, for example, by a factor of two or greater.

It will be appreciated that the elongated U-shape and orientation of reinforcing members 28, 30 may be scaled based on, at least in part, an intended use-case application. For example, the proportions of the length and width of the U-shaped member may be selected to suit a particular application. As shown, e.g., in FIGS. 1 and 3, in an embodiment in which coupling structure 14 may include more than one web (e.g., webs 16, 18), transport tanker 10 may include a separate load spreading structure associated with each web (e.g., reinforcing members 28, 30 associated with respective webs 16, 18). In a generally corresponding manner, embodiments of a transport tanker including a greater or fewer number of webs may include a greater or fewer number of load spreading structures.

In an embodiment, the load spreading structures may be configured with a balanced degree of stiffness and flexibility. The balance between the stiffness and flexibility of the load spreading structures may, for example, spread at least a portion of a load experienced by tank body 12 in a region proximate a terminal end (e.g., terminal ends 24, 26) of the webs (e.g., webs 16, 18) across an enhanced longitudinal expanse of tank body 12, e.g., as opposed to simply moving the location of the high stress and/or deformation of tank body 12 from terminal ends 24, 26 of webs 16, 18 to a region proximate the arcuate sections of the reinforcing members (e.g., proximate arcuate section 36 of reinforcing member 28). With particular reference to FIG. 6, in an embodiment, reinforcing member 28 may include a first height (e.g., H1) proximate the first end. Reinforcing member 28 may also include a second height (H2) proximate terminal end 24 of web 16. First height H1 may be less than second height H2. First height H1 and second height H2 may generally include a height of projection of reinforcing member 28 from tank body 12. The ratio of H1 to H2 may be selected for given applications to achieve a desired balance of stiffness and flexibility about the length of the reinforcing members. As such, the stiffness of reinforcing member 28 may decrease from the region proximate terminal end 24 of web 16 toward the first end of reinforcing member 28. In an embodiment, the decrease in stiffness of reinforcing member 28 from the region proximate terminal 24 of web 16 toward the first end may allow a load in the region of terminal end 24 to be smoothly dissipated and/or dispersed into tank body 12, rather than simply being transferred to the first end of reinforcing member 28.

In addition/as an alternative to managing the relative flexibility and/or stiffness of reinforcing member 28 along the length of legs 32, 34 based on relative first height H1 and second height H2, a desired stiffness/flexibility profile may be achieved, at least in part, based on a taper between first height H1 and second height H2. In this regard, reinforcing member 28 may include various different taper profiles by which reinforcing member 28 may taper between first height H1 and second height H2. For example, reinforcing member 28 may include a generally linear taper profile between first height H1 and second height H2, a concave taper profile between first height H1 and second height H2, a convex taper profile between first height H1 and second height H2, and/or a combination thereof. Further, the location of first height H1 and second height H2 relative to the first end and terminal end 24, respectively, may be selected to achieve a desired balance of stiffness and flexibility of reinforcing member 28.

Additionally, reinforcing member 28 may also include a third height (e.g., H3) proximate the second end of reinforcing member 28. In an embodiment, third height H3 may be less than second height H2. In such an embodiment, a load and/or stress generally concentrated in the region of terminal end 24 of web 16 may also be dissipated and/or dispersed into tank body 12 toward the end of tank body 12. As with the ratio of H1 to H2, the ratio of H2 to H3 may be selected to achieve a desired balance of stiffness and flexibility about the length of the reinforcing members. As with the transition between first height H1 and second height H2, reinforcing member 28 may generally taper between second height H2 and third height H3 according to various suitable tapering profiles, such as linear, concave, convex, etc.

Various additional/alternative configurations may be utilized to manage the flexibility and stiffness of a load spreading structure. For example, in addition/as an alternative to providing the legs of the elongated U-shaped member having varying heights, the thickness and/or thickness profile (e.g., thickness across the height of each leg) of each leg may vary along the length of the legs. In such an embodiment, relatively thicker regions of the legs may be relatively stiffer than thinner regions of the legs. Similarly, the legs may include cutout regions, varying cross-sectional profiles, etc., that may allow a desired balance of stiffness and flexibility to be achieved, such that loads and/or stresses may be dissipated over and/or transferred to a larger expanse of tang body 12.

While in some embodiments, coupling structure 14 (including webs 16, 18) may be directly affixed to tank body 12, in other embodiments, transport tanker 10 may further include one or more longitudinal pads (e.g., pads 40, 42 shown in FIGS. 1 through 3) affixed to longitudinal wall 20 of tank body 12. Longitudinal pads 40, 42 (e.g., which may include sill pads in an embodiment in which transport tanker 10 may include a rail tank car) may generally include reinforcing plates that may be attached to tank body 12 (e.g., to longitudinal wall 20 of tank body 12). In such an embodiment, longitudinal pads 40, 42 may provide additional structure to tank body 12, e.g., in a configuration in which tank body 12 may include a structural and/or semi-structural component of transport tanker 10. In one such embodiment, webs 16, 18 may be affixed to tank body 12 via respective longitudinal pads 40, 42. In a generally corresponding manner, reinforcing members 28, 30 may be directly affixed to tank body 12. Further, in an embodiment in which transport tanker 10 may include longitudinal pads 40, 42 (e.g., via which webs 16, 18 may be affixed to tank body 12), reinforcing members 28, 30 may similarly be affixed to tank body 12 via longitudinal pads 40, 42. While the illustrated example makes use of two separate pads (e.g., with one pad being associated with a respective web and a respective reinforcing member), in other embodiments, a single pad may be utilized. In one such example, more than one web and more than one reinforcing member may be affixed to the tank body through the single pad. Other configurations may similarly be utilized.

In an embodiment, webs 16, 18, as well as reinforcing members 28, 30 may be affixed to tank body 12 (and/or longitudinal pads 40, 42) by being welded thereto. In an embodiment, reinforcing members 28, 30 may be suitable affixed to tank body 12 (and/or to longitudinal pads 40, 42) by being welded only about an outer perimeter of the U-shaped member. In such an embodiment, facile affixment of reinforcing member 28, 30 may not require welding along the interior perimeter of the U-shaped member (e.g., along an inner expanse of legs 32, 34 defining interior region 38). In such an embodiment, reinforcement members 28, 30 may generally minimize necessary attachment welding. Further, in an embodiment, reinforcement members 28, 30 may be welded to tank body 12 and/or pads 40, 42 using a fillet weld about the arcuate section (e.g., arcuate section 36 of reinforcement member 28). In addition/as an alternative to welding, the coupling structure (e.g., which may include one or more webs) and/or one or more reinforcing members may be affixed to the tank body using other suitable means, such as adhesives (e.g., epoxy, urethane, or other suitable adhesive), mechanical fasteners (e.g., bolts, rivets, or other suitable fasteners), or other the like.

Reinforcing members 28, 30 may also include a bridge plate (e.g., bridge plates 44, 46, best depicted in FIGS. 3 through 7) extending between the two legs (e.g., legs 32, 34 of reinforcement member 28) proximate the terminal end of the web (e.g., terminal ends 24, 26 of webs 16, 18). For example, as shown in FIG. 1, transport tanker 10 may include stress transfer structures (not shown in FIGS. 2 and 3 for clarity of illustration). The stress transfer structures may include respective pairs of lever arms 48, 50 and 52, 54 respectively associated with webs 16, 18. Each pair of arms may be coupled by respective transfer bars (e.g., transfer bar 56 coupling lever arms 48, 50 and transfer bar 58 coupling lever arms 52, 54). Consistent with such an arrangement, deformation of tank body proximate any lever arm (e.g., which may give rise to a deflection of the lever arm) may result in a load being at least partially transferred to a second lever arm via an associated transfer bar. Lever arms 48, 52 (respectively proximate terminal ends 24, 26 of webs 16, 18) may be affixed to respective bridge plates 44, 46.

Transport tanker 10 may, in an example embodiment as generally described above, include rail tank car. In such an embodiment, coupling structure 14 may include a draft sill structure of the rail car. As generally discussed above, in some embodiments tank body 12 may be a structural and/or semi-structural component of transport tanker, 10 in which at least a portion of the structural loads and/or demands of the transport tanker may be carried by tank body 12. In such a configuration, a frame separate from tank body 12 may be eliminated and/or minimized. For example, in the illustrated example embodiment, transport tanker 10 may include a stub sill rail tank car, in which coupling structure 14 may extend about only a portion of the length of tank body 12. A stub sill coupling structure may generally include one or more longitudinal structural members that may be attached near each end of transport tanker. Further, in such an embodiment coupling structure 14 may include a draft sill structure of the rail tank car, in which the draft sill structure may be configured to include and/or be associated with a rail car coupling, e.g., which may allow transport tanker 10 to be coupled with one or more other rail cars, including cargo rail cars (including, but not limited to other transport tankers), locomotive engines, and/or other cars. Additionally/alternatively, coupling structure 14 may be configured for coupling with a truck, or wheel assembly. Other configurations may be similarly utilized.

In a further example embodiment, transport tanker 10 may include a tanker trailer, for example, as may be utilized in connection with a tractor-trailer arrangement. In an example of such an embodiment, coupling structure 14 may include a fifth wheel coupling structure of the trailer. Additionally/alternatively, coupling structure 14 may include a carriage assembly that may allow tank body 12 to be coupled (directly and/or indirectly) to a wheel assembly. In such an embodiment, coupling structure 14 may transfer a towing load to tank body 12 in that a towing load provided by a tractor may be transferred through tank body 12 and coupling structure 14, which may couple tank body 12 to a wheel assembly allowing tank body 12 to be towed by the tractor. Other configurations may be similarly utilized.

While the example embodiments herein have generally related to reinforcing structures and methods that may be implemented in connection with a transport tanker, such use is not intended to be a limitation on the present disclosure. Load spreading structures as described herein may suitably be used in connection with any weld terminations that may be subject to cyclic loading, such as structures on earth moving equipment, heavy machinery, ships and the like. For example, load spreading structures as described herein may be utilized to reinforce any weld termination, for example, by spreading and distributing concentrated loads and/or stresses that may be realized at an un-reinforced weld termination.

Having thus described the disclosure of the present application in detail and by reference to implementations thereof, it will be apparent that modifications and variations are possible without departing from the scope of the disclosure defined in the appended claims.

What is claimed is:

1. A transport tanker comprising a tank body;

a coupling structure proximate a first end of the tank body for transferring a towing load to the tank body, the coupling structure including a web protruding from the tank body, and affixed to the tank body, the web including a terminal end portion inboard of the tank body relative to the first end; and a load spreading structure affixed to the tank body including at least one longitudinal member extending from the tank body and disposed alongside, and laterally spaced from, the web and extending longitudinally inwardly along the tank body relative to the terminal end portion of the web and extending longitudinally outwardly along the tank body relative to the terminal end portion of the web, the longitudinal member configured to spread at least a portion of a load experienced by the tank body in a region proximate the terminal end portion of the web across an enhanced longitudinal expanse of the tank body, wherein the longitudinal member includes a first height proximate an inward end, and a second height proximate the terminal end of the web, the first height being less than the second height.

2. The transport tanker of claim 1, wherein the longitudinal member is a reinforcing member including an elongated U-shaped member including two legs joined at the inward end by an arcuate section and open at a second end opposite the inward end, wherein the two legs include a first leg and a second leg, the first leg disposed on one side of the web and the second leg disposed on the opposite side of the web, the web being at least partially received within the open second end of the U-shaped member.

3. The transport tanker of claim 1, wherein the longitudinal member includes a third height proximate a second end, the third height being less than the second height.

4. The transport tanker of claim 1, wherein the longitudinal member includes two legs, and further includes a bridge plate extending between the two legs proximate the terminal end portion of the web.

5. The transport tanker of claim 2, further including a longitudinal pad affixed to a longitudinal wall of the tank body, the web affixed to the tank body via the pad.

6. The transport tanker of claim 5, wherein the longitudinal member is affixed to the tank body via the pad.

7. The transport tanker of claim 6, wherein the web and the longitudinal member are welded to the pad.

8. The transport tanker of claim 7, wherein the longitudinal member is welded to the pad via a weld about an outer perimeter of the U-shaped member.

9. The transport tanker of claim 8, wherein the longitudinal member is welded to the pad via a fillet weld about the arcuate section.

10. The transport tanker of claim 1, wherein the transport tanker includes rail tank car, and the coupling structure includes a draft sill structure.

11. The transport tanker of claim 1, wherein the transport tanker includes a tanker trailer, and the coupling structure includes a fifth wheel coupling structure.

12. A transport tanker comprising:

a rail tank car including:

a tank body;

a sill pad welded along a portion of a longitudinal wall of the tank body; and a draft sill structure proximate a first end of the tank body, the draft sill structure including a draft sill web welded to the sill pad, the web including a terminal end portion inboard of the tank body relative to the first end, and the draft sill structure further including a rail car coupler; and a reinforcing member welded to the sill pad, the reinforcing member including two longitudinal members disposed alongside the web and extending longitudinally inwardly along the tank body relative to the terminal end portion of the web and extending longitudinally outwardly along the tank body relative to the terminal end portion of the web, a first one of the two longitudinal members disposed on one side of the web and a second one of the two longitudinal members disposed on the opposite side of the web, the reinforcing structure having a first height proximate an inward end and a second height proximate the terminal end portion of the draft sill web, the first height being less than the second height, and having a third height proximate the second end being less than the second height.

13. The transport tanker of claim 12, wherein the reinforcing member tapers between the first height and the second height, and tapers between the second height and the third height.

14. The transport tanker of claim 12, wherein the reinforcing member is welded to the sill pad about an outer perimeter of the each of the two longitudinal members.

15. The transport tanker of claim 14, wherein the reinforcing member is welded to the sill pad via a fillet weld.

16. A method for reinforcing a transport tanker comprising:

providing a reinforcing member including at least one longitudinal member; and affixing the reinforcing member to a tank body of the transport tanker wherein the longitudinal member extends alongside of a web of a coupling structure affixed proximate a first end of the tank body, the web protruding from the tank body and affixed to the tank body, wherein the longitudinal member extends longitudinally inwardly along the tank body beyond an inward terminal end of the web, and extends longitudinally outwardly along the tank body relative to the inward terminal end of the web, and wherein the longitudinal member includes a first height proximate an inward end, and a second height proximate the terminal end of the web, the first height being less than the second height.

17. The method of claim 16, wherein affixing the reinforcing member to the tank body includes welding the reinforcing member to the tank body about an outer perimeter of the longitudinal member.

18. The method of claim 17, wherein welding the reinforcing member to the tank body includes fillet welding the reinforcing member to the tank body.

19. The method of claim 17, wherein the web is affixed to the tank body via a longitudinal pad affixed to a longitudinal wall of the tank body, and wherein affixing the reinforcing member to the tank body includes welding the reinforcing member to the pad.

* * * * *